US007766440B2

(12) United States Patent
Kusunoki

(10) Patent No.: US 7,766,440 B2
(45) Date of Patent: Aug. 3, 2010

(54) IMAGE FORMING APPARATUS AND METHOD

(75) Inventor: Naoki Kusunoki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 813 days.

(21) Appl. No.: 11/518,934

(22) Filed: Sep. 12, 2006

(65) Prior Publication Data

US 2007/0058021 A1 Mar. 15, 2007

(30) Foreign Application Priority Data

Sep. 13, 2005 (JP) ..... 2005-265619

(51) Int. Cl.
*B41J 29/38* (2006.01)
*B41J 2/01* (2006.01)

(52) U.S. Cl. ..... 347/14; 347/102

(58) Field of Classification Search ..... 347/102, 347/9, 14, 19

See application file for complete search history.

(56) References Cited

U.S. PATENT DOCUMENTS

2002/0015069 A1* 2/2002 Yamamoto et al. ..... 347/21
2004/0141040 A1* 7/2004 Nakajima ..... 347/102
2004/0189728 A1 9/2004 Nakajima
2004/0196322 A1* 10/2004 Nakajima et al. ..... 347/102

FOREIGN PATENT DOCUMENTS

JP 2004009483 A * 1/2004
JP 2004-314598 A 11/2004

* cited by examiner

*Primary Examiner*—Matthew Luu
*Assistant Examiner*—Rut Patel
(74) *Attorney, Agent, or Firm*—Birch, Stewart, Kolasch & Birch, LLP

(57) ABSTRACT

The image forming apparatus comprises: an ink ejection head which deposits radiation-curable ink onto a recording medium; a radiation curing device which irradiates the deposited radiation-curable ink on the recording medium with radiation to cure the deposited radiation-curable ink; and a correction device which performs correction processing of a volume of the radiation-curable ink to be deposited on the recording medium according to a variation in optical density change of a coloring material in the radiation-curable ink produced by difference in irradiation conditions of the radiation.

7 Claims, 14 Drawing Sheets

FIG.14A

| | INCOMPLETE CURING DUE TO HIGH-INTENSITY UV IRRADIATION DOES NOT OCCUR | INCOMPLETE CURING DOES OCCUR |
|---|---|---|
| LOW-SPEED PRINT MODE | Qa=Ea × ta | Qa=Ea × ta |
| HIGH-SPEED PRINT MODE | Qb=Eb × tb (Qa=Qb) | Qb'= Eb' × tb (Qb'>Qa=Qb) |

FIG.14B

| INCOMPLETE CURING DUE TO HIGH-INTENSITY UV IRRADIATION DOES NOT OCCUR | UV IRRADIATION CONDITIONS (Qa=Qb) | OPTICAL DENSITY CHANGE OF COLORING MATERIAL (FADING) |
|---|---|---|
| LOW-SPEED PRINT MODE | Qa=Ea × ta | RELATIVELY LARGE |
| HIGH-SPEED PRINT MODE | Qb=Eb × tb | RELATIVELY SMALL |

FIG.15

| HIGH-SPEED PRINT MODE | CURING REACTION | REACTION DUE TO OPTICAL DENSITY CHANGE OF COLORING MATERIAL |
|---|---|---|
| CASE 1 | IF INCOMPLETE CURING DUE TO HIGH-INTENSITY UV IRRADIATION OCCURS, THEN INCREASE IN UV IRRADIATION INTENSITY E IS NECESSARY | DETERIORATION OF COLORING MATERIAL IS INCREASED BY INCREASE IN UV IRRADIATION INTENSITY, AND FINAL OPTICAL DENSITY OF COLORING MATERIAL IS RELATIVELY LOWER |
| CASE 2 | IF INCOMPLETE CURING DOES NOT OCCUR, THEN THERE IS NO NEED TO INCREASE UV IRRADIATION INTENSITY E | SINCE UV IRRADIATION INTENSITY IS NOT INCREASED, THERE IS LITTLE DETERIORATION OF COLORING MATERIAL, AND FINAL OPTICAL DENSITY OF COLORING MATERIAL IS RELATIVELY HIGHER |

FIG.17A

| PRINT MODE | OPTICAL DENSITY OF C INK | OPTICAL DENSITY OF M INK | OPTICAL DENSITY OF Y INK |
|---|---|---|---|
| LOW-SPEED PRINT MODE $E_1xt_1$ | $OD_C$=C1 | $OD_M$=M1 | $OD_Y$=Y1 |
| HIGH-SPEED PRINT MODE $E_2xt_2$ | $OD_C$=C2 | $OD_M$=M2 | $OD_Y$=Y2 |

FIG.17B

| | PRELIMINARY CURING LIGHT SOURCE 16A(K) | PRELIMINARY CURING LIGHT SOURCE 16B(M) | PRELIMINARY CURING LIGHT SOURCE 16C(C) | MAIN CURING LIGHT SOURCE 18(Y) | OPTICAL DENSITY OF K INK | OPTICAL DENSITY OF C INK | OPTICAL DENSITY OF M INK | OPTICAL DENSITY OF Y INK |
|---|---|---|---|---|---|---|---|---|
| LOW-SPEED PRINT MODE $E_1xt_1$ | E1K×t1K | E1M×t1M | E1C×t1C | E1Y×t1Y | $OD_K$=K1 | $OD_C$=C1 | $OD_M$=M1 | $OD_Y$=Y1 |
| HIGH-SPEED PRINT MODE $E_2xt_2$ | E2K×t2K | E2M×t2M | E2C×t2C | E2Y×t2Y | $OD_K$=K2 | $OD_C$=C2 | $OD_M$=M2 | $OD_Y$=Y2 |

IMAGE FORMING APPARATUS AND METHOD

BACKGROUND OF THE INVENTION

1. Field of the Invention

The present invention relates to an image forming apparatus and method, more particularly to an image forming apparatus and method using ultraviolet-curable ink and performing tonal graduation correction for compensating variation in the optical density change of the coloring material due to difference in ultraviolet light irradiation conditions.

2. Description of the Related Art

As an image forming apparatus, an inkjet printer (inkjet recording apparatus) is known, which comprises an inkjet head having an arrangement of a plurality of nozzles and forms images on a recording medium by ejecting droplets of ink from the nozzles toward the recording medium while causing the inkjet head and the recording medium to move relatively to each other.

In particular, technology using ultraviolet-curable ink (so-called UV ink) in an inkjet type image forming apparatus is known.

For example, among image forming apparatuses aimed at achieving good ink curing properties with any type of recording speed, without involving complicated changes in the exposure conditions, there is known an image forming apparatus which forms an image by ejecting ultraviolet-curable ink toward a recording medium by means of an inkjet type of recording head and then curing and fixing the ink deposited on the recording medium by irradiating ultraviolet light from an irradiation device, and which, more particularly, reduces the maximum ejection volume of the ink when in a recording mode using a fast image recording speed, and increases the maximum ejection volume of the ink when in a recording mode using a slow image recording speed (see, for example, Japanese Patent Application Publication No. 2004-314598).

In the inkjet type image forming apparatus using UV-curable ink in the related art, even in a high-speed printing mode using a fast image recording speed, the UV irradiation energy amount that is irradiated onto the ink deposited on the recording medium is set to the same level as in a low-speed printing mode using a slow image recording speed, in order to cure the ink in the same manner as in the low-speed printing mode.

The UV irradiation energy amount is the product of the irradiation intensity and the irradiation duration, and in the case of the high-speed printing mode, since the recording medium is conveyed at high speed and the irradiation duration is shortened, then it is necessary to raise the irradiation intensity by a corresponding amount.

However, even in cases where the UV irradiation energy amount represented by the product of the irradiation intensity and the irradiation duration is the same, if the irradiation intensity is raised, then a phenomenon occurs whereby there is variation in the curing reaction of the ultraviolet-curable ink and/or the fading reaction of the coloring material. When a phenomenon of this kind occurs, then the optical density change of the coloring material varies, and a difference in the color density of the coloring material arises between the high-speed printing mode and the low-speed printing mode, for example. Consequently, depending on the printing mode, an image of the prescribed tonal graduations can not be obtained.

Furthermore, in the apparatus described in Japanese Patent Application Publication No. 2004-314598, for example, it is sought to achieve a reliable curing reaction by reducing the maximum ejection volume in the case of the high-speed recording mode and increasing the maximum ejection volume in the case of the low-speed recording mode. However, in the case of the high-speed print mode, when the irradiation intensity is increased, variation occurs in the curing reaction of the ultraviolet-curable ink and/or the fading reaction of the coloring material as described above, thus leading to an alteration in the optical density of the coloring material compared to the low-speed printing mode. Nevertheless, Japanese Patent Application Publication No. 2004-314598 makes no mention of this problem and is not able to resolve the problem.

SUMMARY OF THE INVENTION

The present invention has been contrived in view of the aforementioned circumstances, an object thereof being to provide an image forming apparatus and image forming method using a radiation-curable ink whereby an image of a prescribed tonal graduation can be obtained, even if there is variation in the optical density change of the coloring material due to difference in the radiation irradiation conditions.

In order to attain the aforementioned object, the present invention is directed to an image forming apparatus, comprising: an ink ejection head which deposits radiation-curable ink onto a recording medium; a radiation curing device which irradiates the deposited radiation-curable ink on the recording medium with radiation to cure the deposited radiation-curable ink; and a correction device which performs correction processing of a volume of the radiation-curable ink to be deposited on the recording medium according to a variation in optical density change of a coloring material in the radiation-curable ink produced by difference in irradiation conditions of the radiation.

According to the present invention, even if the optical density change of the coloring material in the ink varies due to difference in the radiation irradiation conditions, it is still possible to obtain an image having a prescribed tonal graduation. The difference in the radiation irradiation conditions is caused by lack of conservation of the product of the irradiation intensity and the irradiation time of the radiation.

Preferably, the correction device performs the correction processing with respect to both a high-speed print mode for recording images at high speed, and a low-speed print mode for achieving high-quality images.

According to this aspect of the present invention, it is possible to respond to difference in the radiation irradiation conditions caused by difference in the print mode.

Alternatively, it is also preferable that the correction device performs the correction processing with respect to a high-speed print mode for recording images at high speed, and performs no correction processing with respect to a low-speed print mode for achieving high-quality images.

According to this aspect of the present invention, it is possible to obtain an optimal image, without correcting optical density, in the low-speed print mode which emphasizes high image quality, while at the same time, it is possible to record images in a state which approaches that of an optimal image, by correcting the optical density, in the high-speed print mode which emphasizes high recording speed.

Preferably, the correction device performs the correction processing in accordance with the irradiation conditions of the radiation corresponding to a type of the recording medium.

According to this aspect of the present invention, it is possible to perform correction in accordance with difference in the radiation irradiation conditions caused by difference in the type of recording medium.

Preferably, the correction device performs the correction processing in accordance with the irradiation conditions of the radiation corresponding to a combination of a type of the recording medium and each of the high-speed print mode and the low-speed print modes.

According to this aspect of the present invention, it is possible to set the irradiation conditions and perform correction in a highly precise fashion, taking account of difference in both the print mode and the type of recording medium.

In order to attain the aforementioned object, the present invention is also directed to an image forming method of forming an image by depositing radiation-curable ink onto a recording medium and irradiating the deposited radiation-curable ink on the recording medium with radiation to cure the deposited radiation-curable ink, the method comprising the steps of: identifying and storing relationships between intensities and durations of radiation irradiation required for radiation-curing of the radiation-curable ink deposited on the recording medium; storing radiation irradiation conditions corresponding to print modes; identifying and storing optical density change values for a coloring material in the radiation-curable ink, corresponding to the radiation irradiation conditions; and correcting a volume of the radiation-curable ink to be deposited on the recording medium with respect to image data inputted, by referring to the stored optical density change values for the coloring material.

According to the present invention, even if the optical density change of the coloring material in the ink varies due to difference in the radiation irradiation conditions, it is still possible to obtain an image having a prescribed tonal graduation. Here, in addition to a high-speed print mode and a low-speed print mode, the print modes may also include variations in the ejection conditions and the radiation irradiation conditions in accordance with difference in the type of recording medium.

As described above, according to the present invention, even if the optical density change of the coloring-material in the ink varies due to difference in the radiation irradiation conditions, it is still possible to obtain an image having a prescribed tonal graduation.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIGS. 10A and 10B are diagrams showing a further composition of a light source section used in a preliminary curing light source, wherein FIG. 10A is a front view and FIG. 10B is a side view;

FIGS. 11A and 11B are diagrams showing a further composition of a light source section used in a preliminary curing light source, wherein FIG. 11A is a front view and FIG. 11B is a side view;

FIG. 14A is a diagram showing UV irradiation conditions for respective print modes, and FIG. 14B is a diagram showing UV irradiation conditions and optical density change in coloring material, for respective print modes;

FIG. 15 is a diagram showing examples of UV curing reaction and optical density change reaction in coloring material in a high-speed print mode;

FIG. 17A is a diagram showing the optical density value of the coloring material after the optical density change due to UV irradiation, and FIG. 17B is a further diagram showing the optical density value of the coloring material after the optical density change due to UV irradiation.

DETAILED DESCRIPTION OF THE PREFERRED EMBODIMENTS

Figure 1:
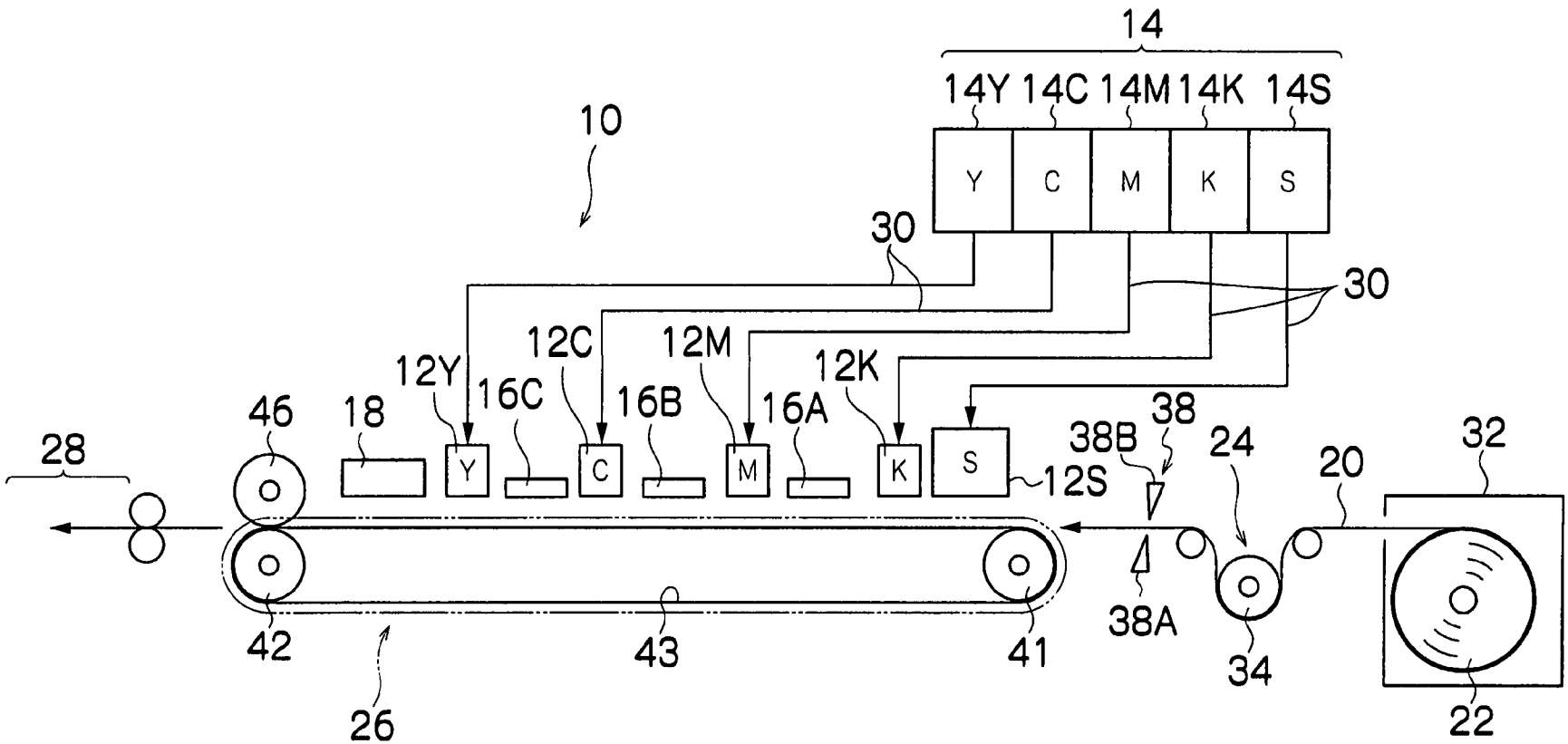
FIG. 1 shows a general schematic drawing of one embodiment of an image forming apparatus according to the present invention.

FIG. 1 shows a general schematic drawing of an image forming apparatus according to an embodiment of the present invention.

As shown in FIG. 1, the image forming apparatus 10 comprises a plurality of inkjet heads (hereinafter, called "print heads") 12K, 12M, 12C and 12Y for ink colors of black (K), magenta (M), cyan (C), and yellow (Y), respectively, and a treatment liquid ejection head 12S; an ink storing and loading unit 14 for storing ultraviolet-curable inks (so-called "UV inks") to be supplied to the print heads 12K, 12M, 12C and 12Y, and treatment liquid to be supplied to the treatment liquid ejection head 12S; preliminary curing light sources 16A, 16B and 16C (also referred collectively to as "preliminary curing light sources 16") provided respectively between the print heads; a main curing light source 18 disposed after the print head 12Y of the last color; a paper supply unit 22 for supplying recording paper 20 forming a recording medium; a decurling unit 24 for removing curl in the recording paper 20; a suction belt conveyance unit 26, disposed facing the nozzle faces (ink ejection faces) of the print heads 12 (12K, 12M, 12C and 12Y) and the treatment liquid ejection head 12S and the light output faces of the respective light sources (16A, 16B, 16C and 18), for conveying the recording paper 20 while keeping the recording paper 20 flat; and a paper output unit 28 for outputting recorded recording paper (a printed object) to the exterior.

The treatment liquid used in the image forming apparatus 10 of the present embodiment contains a polymerization initiator, a dispersion inhibitor, and an oil (high-boiling-point organic solvent), and the UV-curable inks of the respective colors each comprise a component which hardens (polymerizes) due to the application of UV energy (a UV-curable component such as a monomer, oligomer, or a low-molecular-weight homopolymer, copolymer, or the like), and a coloring material (colorant).

By adopting a composition which combines a treatment liquid and inks of respective colors in this way, principally, it is possible to avoid image deterioration caused by deposition interference through the functions of the dispersion inhibitor contained in the treatment liquid. Moreover, even if leaked light from the preliminary curing light sources 16A, 16B and 16C or light reflected by the recording paper 20 reaches the nozzles of the print heads 12K, 12M, 12C and 12Y or the treatment liquid ejection head 12S, then no polymerization reaction will occur, and hence solidification of the treatment liquid or the ink inside the nozzles of the heads can be prevented, since the liquids do not contain the polymerization initiator and the UV monomer together. Furthermore, even in the case of a mode where the inks of the respective colors contain a polymerization initiator and the treatment liquid contains a UV monomer, it is possible to obtain similar beneficial effects to those described above.

The treatment liquid and inks are described in more detail hereinafter.

The ink storing and loading unit 14 has ink tanks 14K, 14M, 14C and 14Y for storing the inks of the colors corresponding to the print heads 12K, 12M, 12C and 12Y, and a tank 14S for storing treatment liquid S, and the tanks are connected respectively to the print heads 12K, 12C, 12M, and 12Y and the treatment liquid ejection head 12S by means of prescribed channels 30. The ink storing and loading unit 14 has a warning device (for example, a display device or an alarm sound generator) for warning when the remaining amount of any ink is low, and has a mechanism for preventing loading errors among the colors.

In FIG. 1, a magazine 32 for rolled paper (continuous paper) is shown as an example of the paper supply unit 22; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-ejection is controlled so that the ink-droplets are ejected in an appropriate manner in accordance with the type of paper.

The recording paper 20 delivered from the paper supply unit 22 retains curl due to having been loaded in the magazine 32. In order to remove the curl, heat is applied to the recording paper 20 in the decurling unit 24 by a heating drum 34 in the direction opposite from the curl direction in the magazine 32. The heating temperature at this time is preferably controlled so that the recording paper 20 has a curl in which the surface on which the print is to be made is slightly round outward.

In the case of the configuration in which roll paper is used, a cutter 38 is provided as shown in FIG. 1, and the continuous paper is cut into a desired size by the cutter 38. The cutter 38 has a stationary blade 38A, whose length is not less than the width of the conveyor pathway of the recording paper 20, and a round blade 38B, which moves along the stationary blade 38A. The stationary blade 38A is disposed on the reverse side of the printed surface of the recording paper 20, and the round blade 38B is disposed on the printed surface side across the conveyor pathway. When cut papers are used, the cutter 38 is not required.

After decurling processing, the cut recording paper 20 is delivered to the suction belt conveyance unit 26. The suction belt conveyance unit 26 has a configuration in which an endless belt 43 is set around rollers 41 and 42 in such a manner that at least the portion of the endless belt 43 facing the nozzle faces of the print heads 12K, 12M, 12C, 12Y and the treatment liquid ejection head 12S forms a plane (flat plane).

The belt 43 has a width that is greater than the width of the recording paper 20, and a plurality of suction apertures (not shown) are formed on the belt surface. A suction chamber (not illustrated) is provided on the inner side of the belt 43 set about the rollers 41 and 42, and the recording paper 20 is and held on the belt 43 by suction by creating a negative pressure in the suction chamber with a fan.

The belt 43 is driven in the counterclockwise direction in FIG. 1 by the motive force of a motor (not shown) being transmitted to at least one of the rollers 41 and 42, which the belt 43 is set around, and the recording paper 20 held on the belt 43 is conveyed from right to left in FIG. 1.

The print heads 12K, 12M, 12C, 12Y and the treatment liquid ejection head 12S are full line heads having a length corresponding to the maximum width of the recording paper 20 used with the image forming apparatus 10, and comprising a plurality of nozzles for ejecting ink arranged on a nozzle face through a length exceeding at least one edge of the maximum-size recording paper 20 (namely, the full width of the printable range).

The print heads 12K, 12M, 12C and 12Y are arranged in the color order (black (K), magenta (M), cyan (C), yellow (Y)) from the upstream side in the delivery direction of the recording paper 20, and the print heads 12K, 12M, 12C and 12Y are fixed extending in a direction substantially perpendicular to the conveyance direction of the recording paper 20.

A color image can be formed on the recording paper 20 by firstly depositing the treatment liquid from the treatment liquid ejection head 12S and then depositing the inks of different colors from the print heads 12K, 12M, 12C and 12Y, respectively, onto the recording paper 20 while the recording paper 20 is conveyed by the suction belt conveyance unit 26.

By adopting a configuration in which full line heads 12K, 12M, 12C and 12Y having nozzle rows covering the full paper width are provided for the separate colors in this way, it is possible to record an image on the full surface of the recording medium 20 by performing just one operation of moving the recording medium 20 relatively with respect to the heads 12K, 12M, 12C and 12Y in the paper conveyance direction (the sub-scanning direction), (in other words, by means of a single sub-scanning action). A single pass image forming apparatus of this kind is able to print at high speed in comparison with a shuttle scanning system in which an image is printed by moving a recording head back and forth reciprocally in the main scanning direction, and hence print productivity can be improved.

Although the configuration with the KCMY four standard colors is described in the present embodiment, combinations of the ink colors and the number of colors are not limited to those. Light inks or dark inks can be added as required. For example, a configuration is possible in which inkjet heads for ejecting light-colored inks such as light cyan and light magenta are added. Furthermore, there are no particular restrictions of the sequence in which the heads of respective colors are arranged.

The preliminary curing light sources 16A, 16B and 16C disposed between the print heads have a length corresponding to the maximum width of the recording paper 20, similarly to the heads, and they are fixed extending in a direction substantially perpendicular to the conveyance direction of the recording paper 20. The preliminary curing light sources 16A, 16B and 16C irradiate ultraviolet light having energy of a level whereby the ink droplets deposited by the print head 12K, 12M or 12C situated adjacently on the upstream side of the irradiating unit is changed to a semi-hardened state (a state where it is not completely hardened, or a semiliquid state).

In other words, the preliminary curing light sources 16 have the function of semi-curing the ink droplets on the recording paper 20 in order to prevent intermixing of inks, in such a manner that ink droplets deposited onto the recording paper 20 by a preceding print head 12K, 12M or 12C do not mix on the recording paper with ink droplets of another color ejected from a subsequent print head 12M, 12C or 12Y, and thus preventing the occurrence of color bleeding.

When the recording paper 20 has passed under an upstream print head unit and before it passes below the next print head, light is irradiated from the preliminary curing light source 16, thereby changing the ink on the recording paper 20 to a semi-cured state, in such a manner that droplets of a different color can be deposited by the subsequent print head.

In the example shown in FIG. 1, after the treatment liquid has firstly been deposited onto the recording paper 20 from the treatment liquid ejection head 12S, and droplets of the black ink have then been deposited by the black head 12K, the black ink is passed through the light irradiated by the preliminary curing light source 16A, and the droplets of the black ink are thereby changed to a semi-hardened state, whereupon droplets of the magenta ink are deposited by the magenta head 12M. Similarly, after deposition of the droplets of the magenta ink by the magenta head 12M, the droplets of the magenta ink pass through light irradiated by the preliminary curing light source 16B, whereupon droplets of the cyan ink are deposited by the cyan head 12C, passed through the light irradiated by the preliminary curing light source 16C, and then droplets of the yellow ink are deposited by the yellow head 12Y.

After deposition of the droplets of the yellow ink by the yellow head 12Y, which is the last color, it is not necessary to perform light irradiation in order to semi-harden the yellow ink, and therefore no preliminary curing light source is provided.

After passing the yellow head 12Y, light of a sufficient amount to harden (fully harden) the ink droplets having been deposited on the recording paper 20 is irradiated by the main curing light source 18, thereby performing main curing in such a manner that no deterioration of the image is caused by subsequent handling (in downstream stages).

A pressurizing and fixing roller 46 is provided on the downstream side of the main curing light source 18. The pressurizing and fixing roller 46 is a device for controlling the glossiness and evenness of the image surface.

The printed object generated in this manner is output via the paper output unit 28. Although not shown in FIG. 1, the paper output unit 28 is provided with a sorter for collecting images according to print orders.

Next, the structure of a head is described. The print heads 12K, 12M, 12C and 12Y provided for the respective ink colors and the treatment liquid ejection head 12S have the same structure, and a reference numeral 50 is hereinafter designated to a representative example of these heads.

Figure 2A:
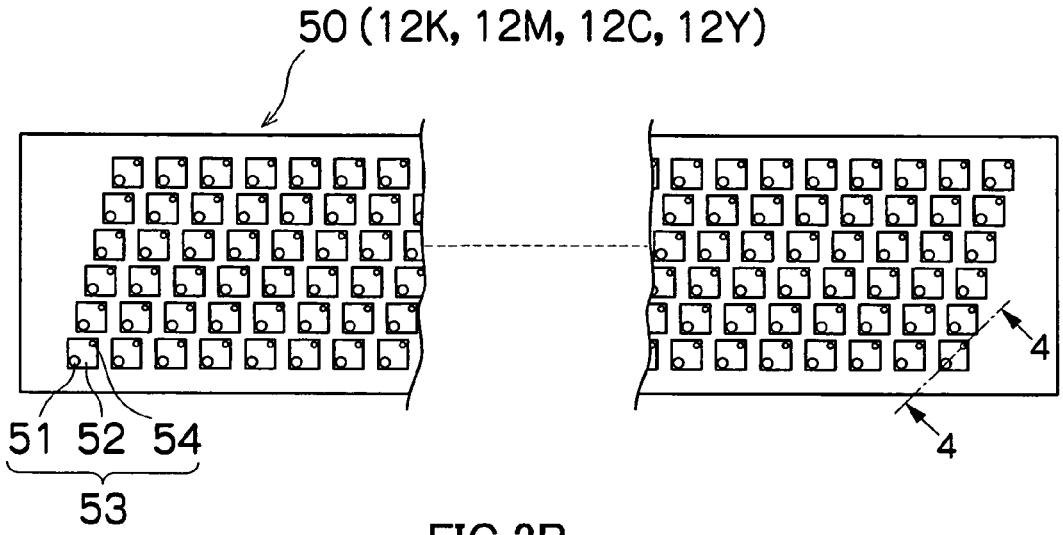
FIG. 2A is plan view perspective diagram showing an example of the structure of a print head.
Figure 2B:
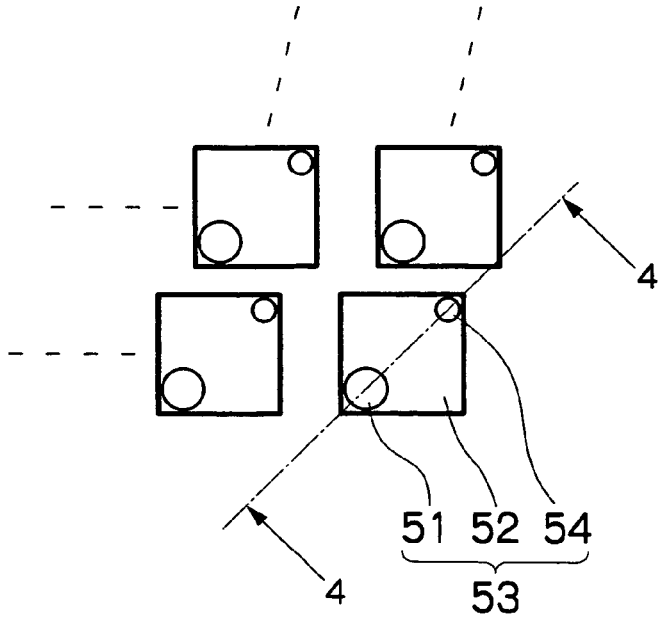
FIG. 2B is an enlarged diagram of a portion of same.
Figure 3:
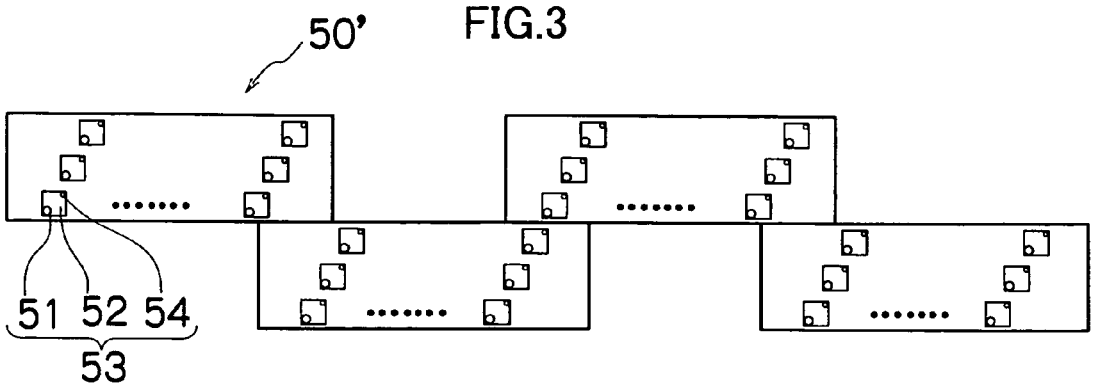
FIG. 3 is a plan view perspective diagram showing a further example of the structure of a head.
Figure 4:
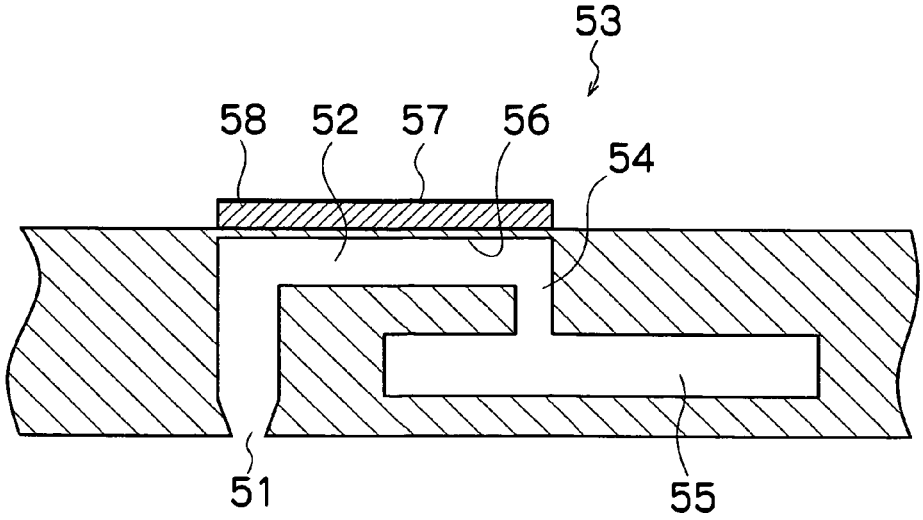
FIG. 4 is a cross-sectional diagram along line 4-4 in FIGS. 2A and 2B.

FIG. 2A is a perspective plan view showing an example of the configuration of the head 50, FIG. 2B is an enlarged view of a portion thereof, FIG. 3 is a perspective plan view showing another example of the configuration of the head 50, and FIG. 4 is a cross-sectional view taken along the line 4-4 in FIGS. 2A and 2B, showing the inner structure of a droplet ejection element (an ink chamber unit for one nozzle 51).

The nozzle pitch in the head 50 should be minimized in order to maximize the resolution of the dots printed on the surface of the recording paper 20. As shown in FIGS. 2A and 2B, the head 50 according to the present embodiment has a structure in which a plurality of ink chamber units (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

The mode of forming one or more nozzle rows through a length corresponding to the entire width of the recording paper 20 in a direction substantially perpendicular to the conveyance direction of the recording paper 20 is not limited to the example described above. For example, instead of the configuration in FIG. 2A, as shown in FIG. 3, a line head having nozzle rows of a length corresponding to the entire width of the recording paper 20 can be formed by arranging and combining, in a staggered matrix, short head units 50' having a plurality of nozzles 51 arrayed in a two-dimensional fashion.

As shown in FIGS. 2A and 2B, the planar shape of the pressure chamber 52 provided for each nozzle 51 is substantially a square, and an outlet to the nozzle 51 and an inlet of supplied ink (supply port) 54 are disposed in both corners on a diagonal line of the square. The planar shape of the pressure chamber 52 is not limited to that described in the present embodiment, thus various shapes such as a quadrilateral shape (rhombus, rectangle, or the like), pentagon, hexagon, other polygonal shapes, circle, and oval shape are possible.

As shown in FIG. 4, each pressure chamber 52 is connected to a common channel 55 through the supply port 54. The common channel 55 is connected to an ink tank (not shown in FIG. 4), which is a base tank that supplies ink, and the ink supplied from the ink tank is delivered through the common flow channel 55 in FIG. 4 to the pressure chambers 52.

An actuator 58 provided with an individual electrode 57 is bonded to a pressure plate (diaphragm) 56 which forms a part (the ceiling in FIG. 4) of the pressure chamber 52. When a drive voltage is applied to the individual electrode 57, the actuator 58 is deformed, the volume of the pressure chamber 52 is thereby changed, and accordingly the pressure in the pressure chamber 52 is changed, so that the ink is thus ejected through the nozzle 51. The actuator 58 is preferably a piezoelectric element. When ink is ejected, new ink is supplied to the pressure chamber 52 from the common flow channel 55 through the supply port 54.

Next, the structure of a preliminary curing light source section is described.

Figure 5:
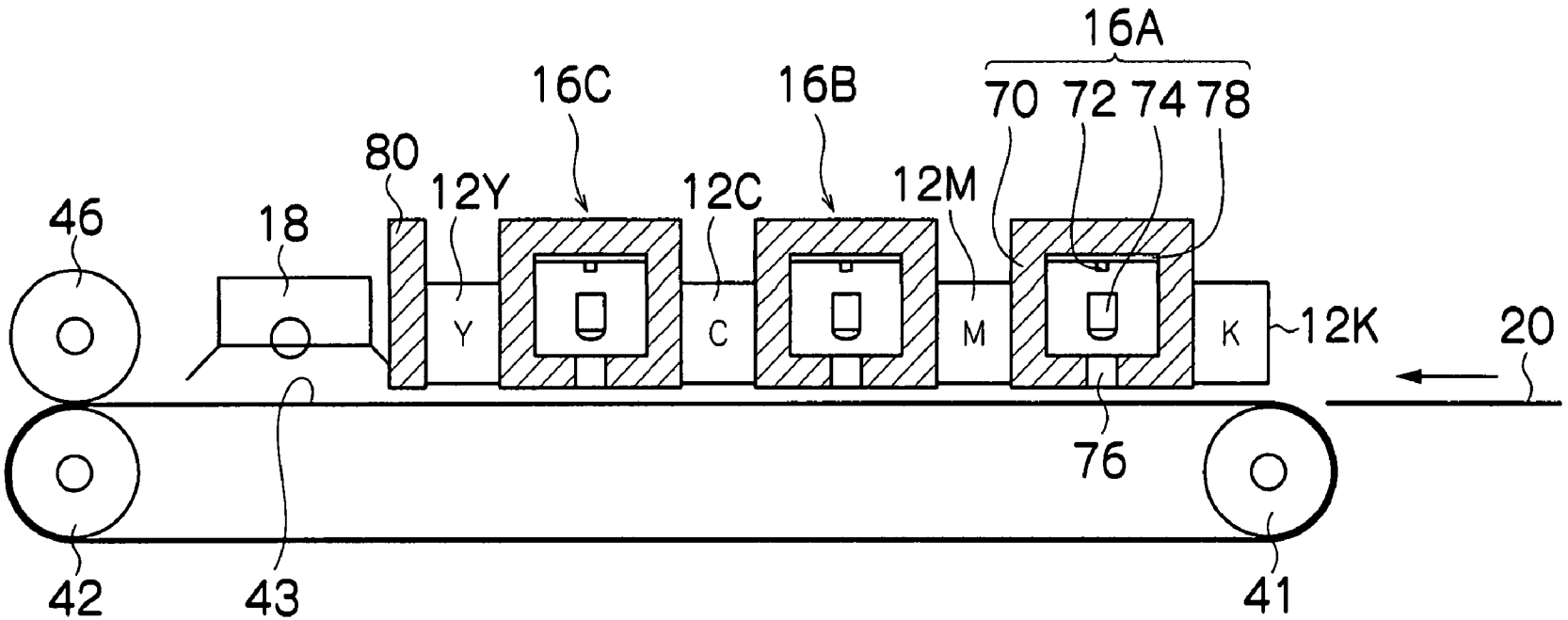
FIG. 5 is a schematic diagram showing an example of the structure of a preliminary curing section.

FIG. 5 is a schematic diagram showing an example of the structure of a preliminary curing section. In FIG. 5, parts which are common to FIG. 1 are denoted with the same reference numerals. As shown in FIG. 5, the preliminary curing light sources 16A, 16B and 16C each have a structure in which linear ultraviolet LED (light-emitting diode) elements 72 and lens systems 74 are disposed inside a light shroud 70. Ultraviolet light condensed into a linear shape is irradiated onto the recording paper 20 situated on the belt 43, via a slit-shaped opening section 76 formed in the base of the light shroud 70. Reference numeral 78 denotes a substrate on which the ultraviolet LED elements 72 are supported.

A mercury lamp, metal halide lamp, or the like, is suitable for use as the main curing light source 18 disposed after the yellow head 12Y. The main curing light source 18 has a broader wavelength range then the ultraviolet LED elements 72, and it outputs a greater amount of light. Furthermore, a light shielding partition member 80 for preventing the light irradiated by the main curing light source 18 from entering into the yellow head 12Y is provided between the yellow head 12Y and the main curing light source 18.

The curing process caused by the preliminary curing light sources 16A, 16B, 16C (hereinafter, these light sources are indicated collectively by the reference numeral 16 in order to simplify the description) may produce a semiliquid state (a state of increased viscosity) where the ink still contains an unhardened portion, in such a manner that color mixing due to interference between ink droplets of different colors on the surface of the recording medium is prevented. Therefore, desirably, respectively different light sources are used for the preliminary curing light sources 16 and for the main curing light source 18, and the relationship between the preliminary curing light source 16 and the main curing light source 18 satisfies at least one of the following conditions:

"Condition 1": "Wavelength range of preliminary curing light source 16"<"Wavelength range of main curing light source 18";

"Condition 2": "Light intensity irradiated by preliminary curing light source 16"<"Light intensity irradiated by main curing light source 18"; and "Condition 3": "Irradiation range of curing light source 16"<"Irradiation range of main curing light source 18".

Here, the central wavelength and the wavelength range of the preliminary curing light source 16 and the main curing light source 18 are selected in accordance with the design specifications of the ink used.

Figure 6:
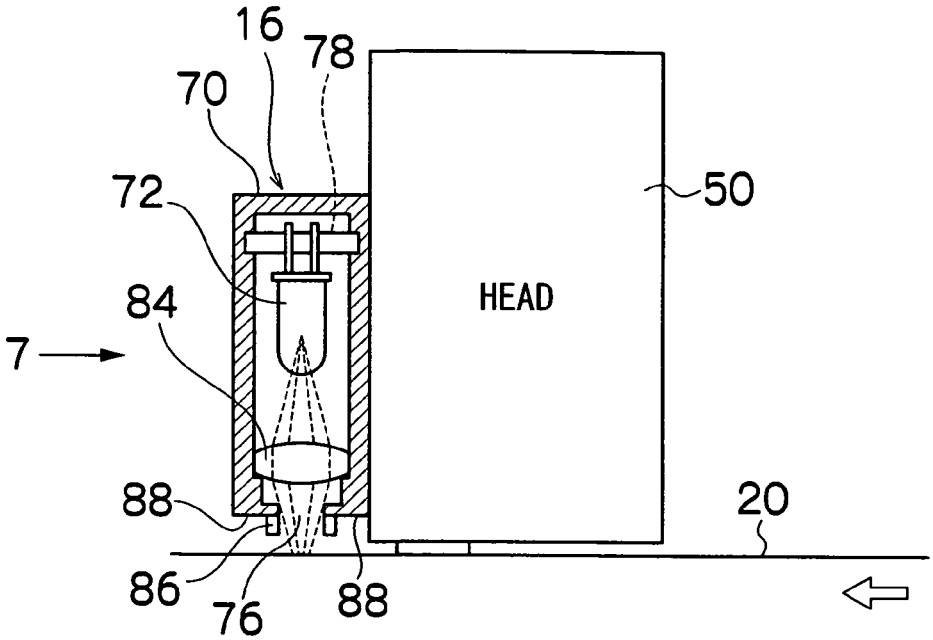
FIG. 6 is a partial cross-sectional diagram showing an example of the detailed structure of a preliminary curing light source.
Figure 7:
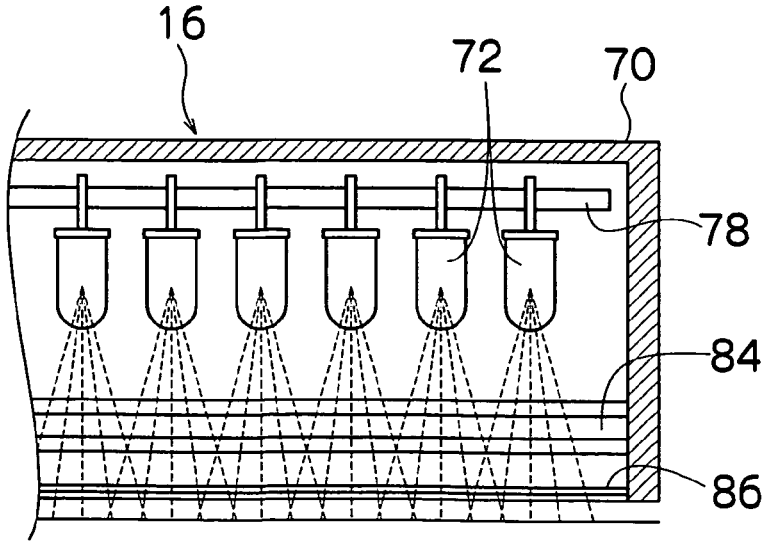
FIG. 7 is a cross-sectional diagram in the direction of arrow 7 in FIG. 6.

FIG. 6 is a partial cross-sectional diagram showing an example of the detailed composition of a preliminary curing light source 16, and FIG. 7 is a cross-sectional diagram along arrow 7 in FIG. 6. As shown in these diagrams, a plurality of ultraviolet LED elements 72 are arranged in the form of a line in the lengthwise direction of the head 50, on a substrate 78 that is disposed inside the light shroud 70. A cylindrical condensing lens 84 is provided below the row of ultraviolet LED elements 72.

A slit-shaped opening 76 forming a light output opening is formed in the base portion of the light shroud 70, and a light-shielding rim 86, which protrudes in the light output direction, is provided about the perimeter of the opening section 76. Furthermore, an ultraviolet absorbing coating 88 is provided on the lower surface of the light shroud 70 facing the recording paper 20.

Scattered light generated by the group of ultraviolet LED elements 72 is condensed into a linear shape in a direction substantially orthogonal to the paper conveyance direction, by the action of the cylindrical lens 84, and the light is irradiated onto the recording paper 20. Instead of the cylindrical lens 84, it is also possible to use a lens group having one or more aspherical surface shaped to achieve diffraction of the light, having a condensing power similar to that of the cylindrical lens 84.

Figure 8:
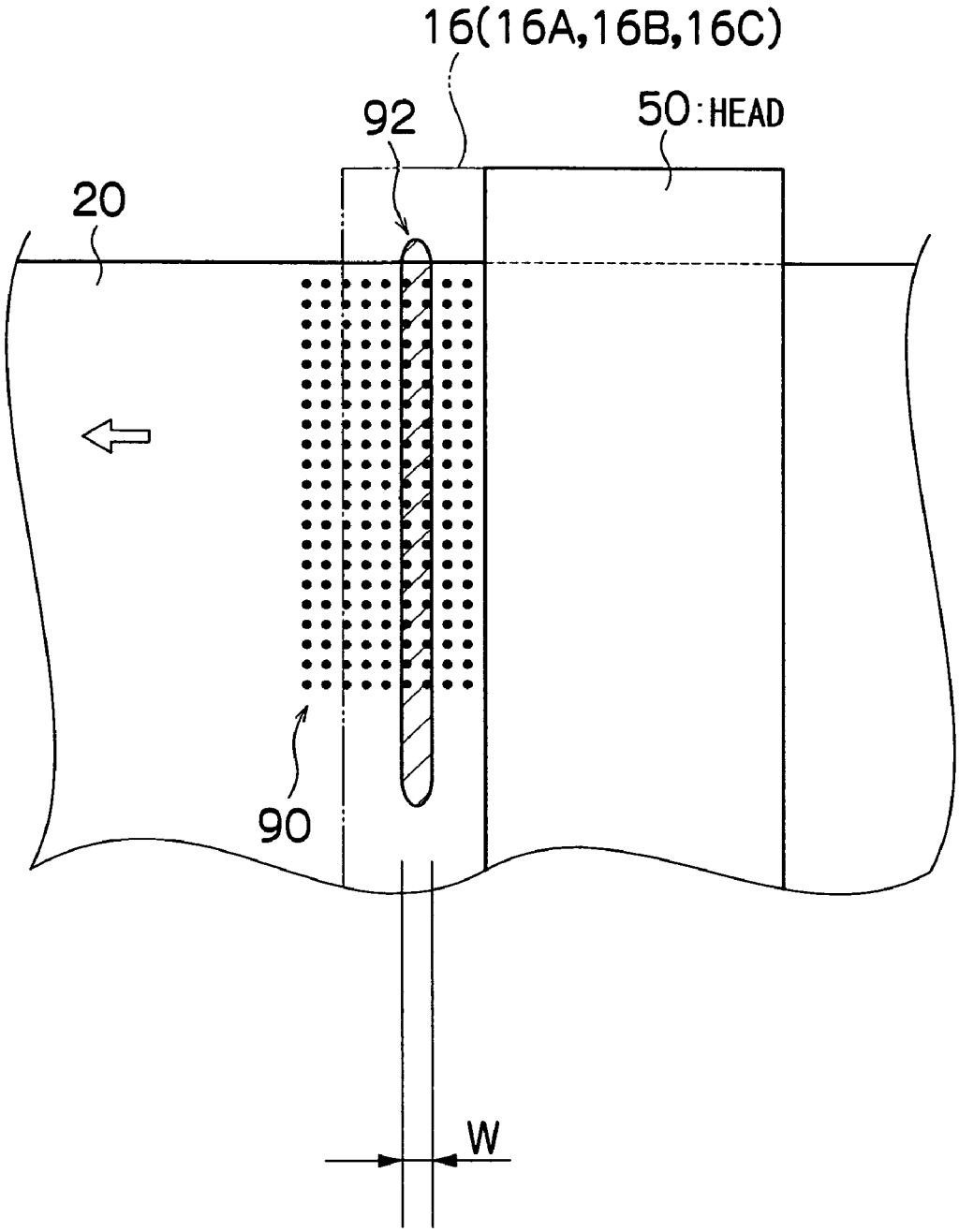
FIG. 8 is a plan diagram showing an example of an ultraviolet light irradiation area irradiated on a recording medium by a preliminary curing light source.

FIG. 8 shows an example of the irradiation area of the ultraviolet light irradiated onto the recording paper 20 by a preliminary curing light source 16 having the structure illustrated in FIG. 6 and FIG. 7.

In FIG. 8, the recording paper 20 is conveyed from right to left in the direction of the outlined arrow and ink is discharged from the head 50. In this way, ink is deposited successively onto the recording paper 20 and dot lines 90 are formed successively in the main scanning direction. The irradiation area 92 of the ultraviolet light irradiated by the preliminary curing light source 16 on the downstream side of the head 50 comprises a linear area that is substantially parallel to the dot lines 90 in the main scanning direction, and this area has a narrow width W in the sub-scanning direction (where W is desirably several dot lines or less).

By selectively lighting up the group of ultraviolet LED elements 72 illustrated in FIGS. 6 and 7, and controlling the intensity of light emitted by each element, it is possible to achieve a desired irradiation range and light quantity (intensity) distribution in the irradiation area 92 of the ultraviolet light.

Figure 9:
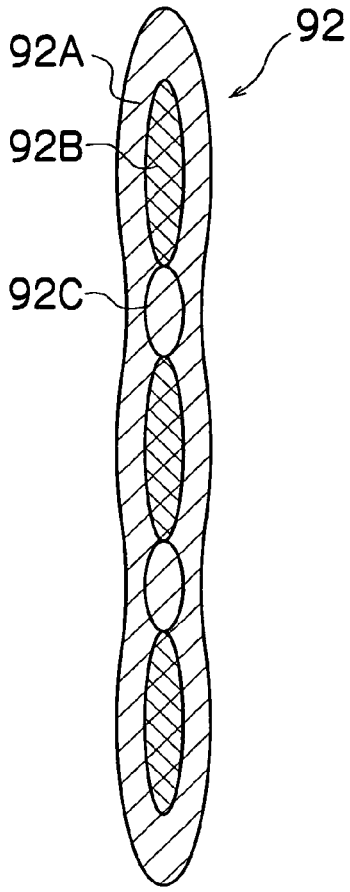
FIG. 9 is an enlarged diagram showing an example of the distribution of the light quantity distribution in the irradiation area of the ultraviolet light emitted from a preliminary curing light source 16.

FIG. 9 is an enlarged diagram showing an example of the light intensity distribution in the irradiation area of the ultraviolet light emitted from the preliminary curing light source 16. In this diagram, reference numeral 92A denotes an area of weak light, reference numeral 92B denotes an area of intense light, and reference numeral 92C denotes a colorless area (namely, an area where no droplet has been deposited by the immediately preceding head). In the colorless area 92C, since no ink droplets have been deposited onto the recording paper 20, there is no need to irradiate ultraviolet light onto this area in order to perform preliminary curing.

Desirably, the light emission positions and the emitted light intensities of the ultraviolet LED elements 72 are controlled suitably in accordance with the size of the recording paper 20 and the droplet ejection range of the head 50, in such a manner that the minimum necessary amount of light is generated, thereby minimizing adverse effects on the head 50.

Figure 10A:
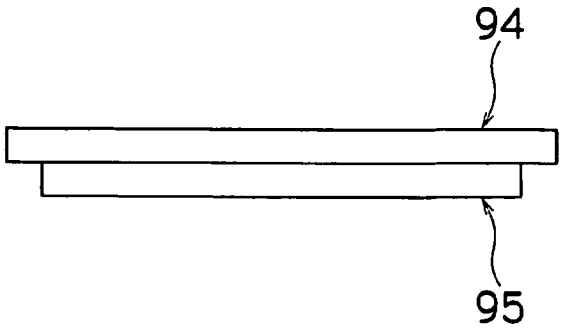
Figure 10B:
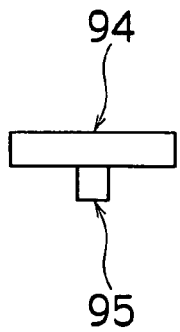
Figure 11A:
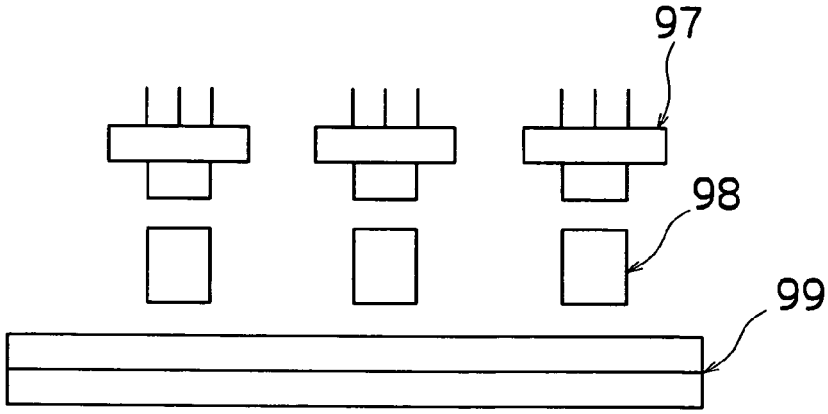
Figure 11B:
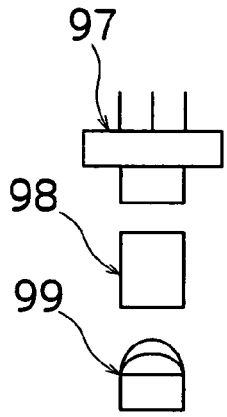

The composition of the preliminary curing light sources 16 is not limited to one using lamp-type ultraviolet LED elements 72 such as those in FIGS. 6 and 7, and it is also possible to arrange an LED element 95 one-dimensionally on a substrate 94, as shown in FIGS. 10A and 10B. Furthermore, a composition using laser diode (LD) elements instead of LED elements may also be adopted. For example, in place of the light source unit composed of a row of lamp-type ultraviolet LED elements 72 and the cylindrical lens 84 such as that illustrated in FIGS. 6 and 7, it is also possible to substitute a light source unit composed of LD elements 97, a condensing lens 98 and a cylindrical lens 99, as shown in FIGS. 11A and 11B.

Next, the control system of the image forming apparatus 10 is described.

Figure 12:
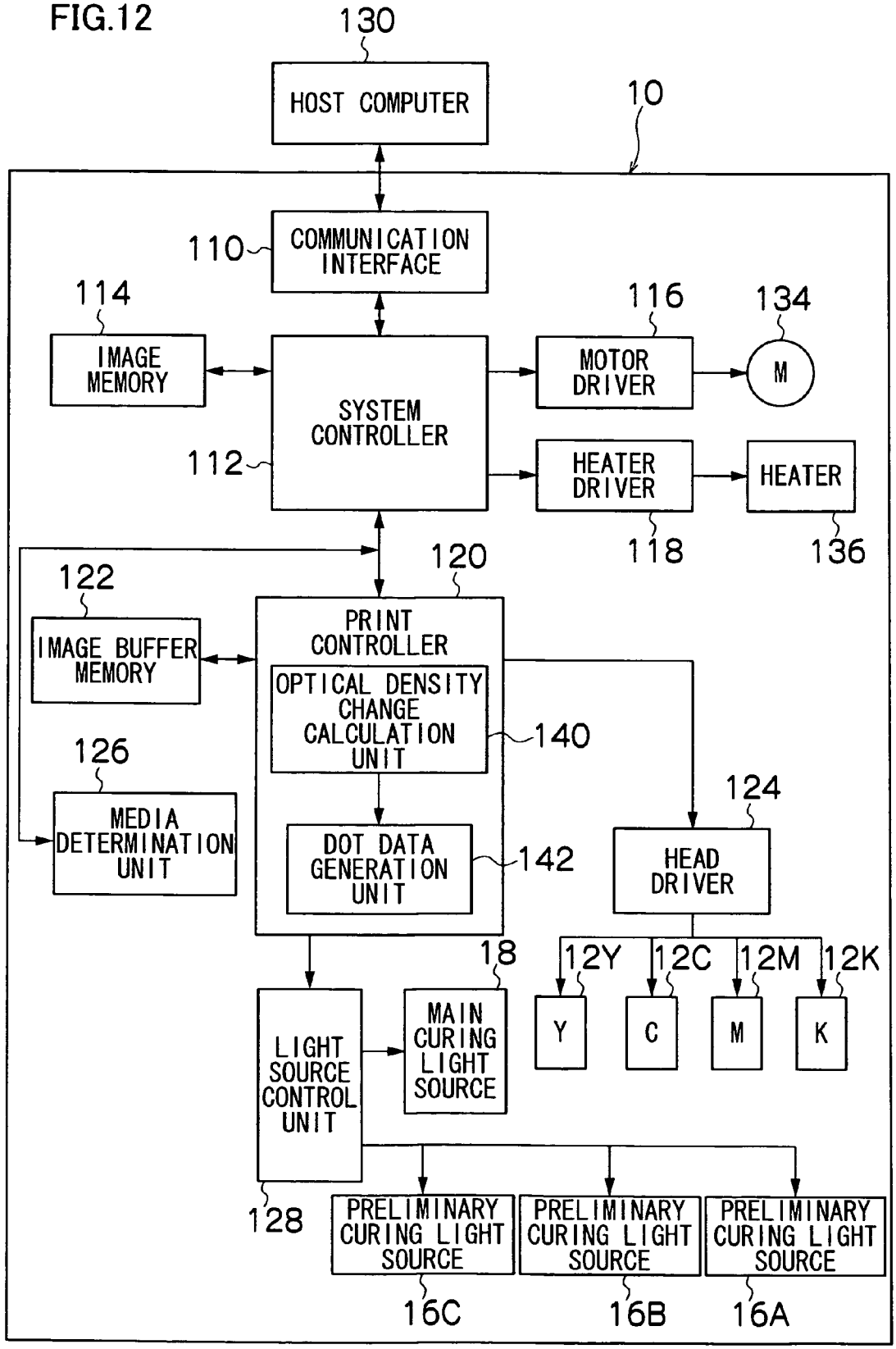
FIG. 12 is a principal block diagram showing the system composition of an image forming apparatus according to the present embodiment.
Figure 13:
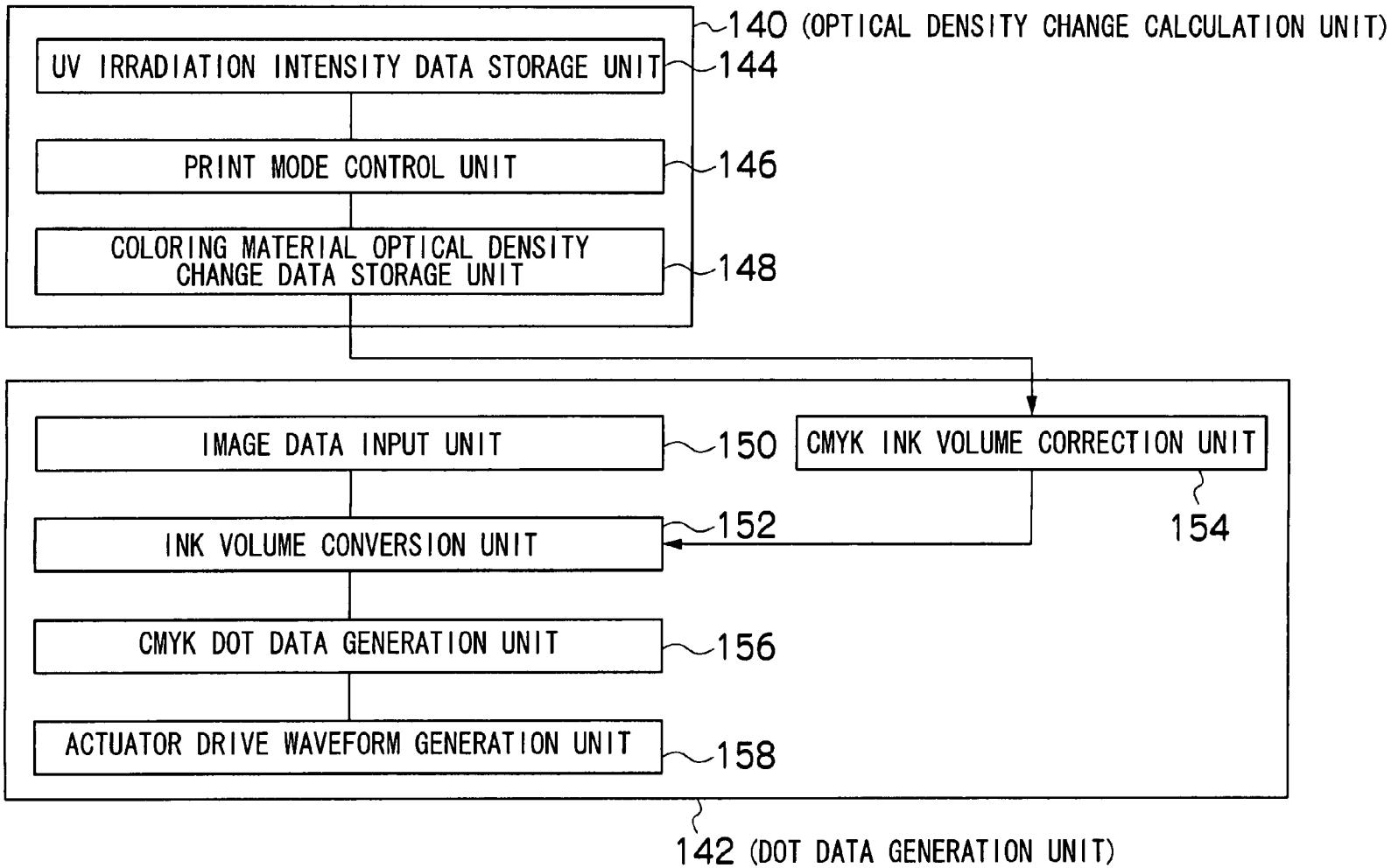
FIG. 13 is a block diagram showing the detailed structure of the optical density change calculation unit and the dot data generation unit in FIG. 12.

FIG. 12 is a principal block diagram showing the system composition of the inkjet forming apparatus 10. The image forming apparatus 10 comprises a communications interface 110, a system controller 112, an image memory 114, a motor driver 116, a heater driver 118, a print controller 120, an image buffer memory 122, a head driver 124, a media determination unit 126, a light source control unit 128, and the like.

The communication interface 110 is an interface unit for receiving image data sent from a host computer 130. A serial interface such as USB, IEEE1394, Ethernet, wireless network, or a parallel interface such as a Centronics interface may be used as the communication interface 110. A buffer memory (not shown) may be mounted in this portion in order to increase the communication speed. The image data sent from the host computer 130 is received by the inkjet forming apparatus 10 through the communication interface 110, and is temporarily stored in the image memory 114. The image memory 114 is a storage device for temporarily storing images inputted through the communication interface 110, and data is written and read to and from the image memory 114 through the system controller 112. The image memory 114 is not limited to a memory composed of semiconductor elements, and a hard disk drive or another magnetic medium may be used.

The system controller 112 is a control unit for controlling the various sections, such as the communications interface 110, the image memory 114, the motor driver 116, the heater driver 118, and the like. The system controller 112 is constituted by a central processing unit (CPU) and peripheral circuits thereof, and the like, and in addition to controlling communications with the host computer 130 and controlling reading and writing from and to the image memory 114, or the like, it also generates a control signal for controlling the motor 134 of the conveyance system and the heater 136.

The motor driver (drive circuit) 116 drives the motor 134 in accordance with commands from the system controller 112. The heater driver 118 drives the heater 136 of the heating drum 34 or other units in accordance with commands from the system controller 112.

The print controller 120 includes an optical density change calculation unit 140 and a dot data generation unit 142, and it has a signal processing function for performing various treatment processes, corrections, and the like, in accordance with the control implemented by the system controller 112, in order to generate a signal for controlling printing, from the image data in the image memory 114. The print controller 120 supplies the print control signal (dot data) thus generated to the head driver 124. Prescribed signal processing is carried out in the print controller 120, and the ejection amount and the ejection timing of ink droplets from the print heads 12K, 12M, 12C and 12Y of the respective colors are controlled via the head driver 124, on the basis of the image data. By this means, prescribed dot sizes and dot positions can be achieved.

The print controller 120 is provided with the image buffer memory 122; and image data, parameters, and other data are temporarily stored in the image buffer memory 122 when image data is processed in the print controller 120. The aspect shown in FIG. 12 is one in which the image buffer memory 122 accompanies the print controller 120; however, the image memory 114 may also serve as the image buffer memory 122. Also possible is an aspect in which the print controller 120 and the system controller 112 are integrated to form a single processor.

The head driver 124 drives the actuators 58 which drive ejection in the respective heads 12K, 12M, 12C and 12Y, on the basis of the dot data supplied from the print controller 120. A feedback control system for maintaining constant drive conditions for the print heads may be included in the head driver 124.

The image data to be printed is externally inputted through the communications interface 110, and is stored in the image memory 114. At this stage, RGB image data is stored in the image memory 114, for example. The image data stored in the image memory 114 is sent to the print controller 120 through the system controller 112, and is converted to the dot data for each ink color by a known dithering algorithm, random dithering algorithm or another technique in the dot data generation unit 142 of the print controller 120.

The print heads 12K, 12M, 12C and 12Y are driven on the basis of the dot data thus generated by the dot data generation unit 142 of the print controller 120, and ink is ejected accordingly from the heads. By controlling ink ejection from the print heads 12K, 12M, 12C and 12Y in synchronization with the conveyance speed of the recording medium 20, an image is formed on the recording medium 20.

The media determination unit 126 is a device for determining the type and size of the recording paper 20. This unit uses, for example, a device for reading in information such as bar codes attached to the magazine 32 in the paper supply unit 22, or sensors disposed at a suitable position in the paper conveyance path (a paper width determination sensor, a sensor for determining the thickness of the paper, a sensor for determining the reflectivity of the paper, and so on). A suitable combination of these elements may also be used. Furthermore, it is also possible to adopt a composition in which information relating to the paper type, size, or the like, is specified by means of an input via a prescribed user interface, instead of or in conjunction with such automatic determination devices.

Information obtained by the media determination unit 126 is reported to at least one of the system controller 112 and the print controller 120, and is used to control ink ejection and to control the preliminary curing light sources 16A, 16B and 16C.

The light source control unit 128 is constituted by a preliminary curing light source control circuit for controlling the on and off switching, lighting up positions, and light emission intensities, and the like, of the preliminary curing light sources 16A, 16B and 16C; and a main curing light source control circuit for controlling the on and off switching and the light emission intensity of the main curing light source 18. The light source control unit 128 controls the light emission by the respective light sources (16A, 16B and 16C) in accordance with the commands from the print controller 120.

Next, the optical density change calculation unit 140 and the dot data generation unit 142 in the print controller 120 are described.

The optical density change calculation unit 140 comprises a UV irradiation intensity data storage unit 144, a print mode control unit 146, and a coloring material optical density change data storage unit 148. The dot data generation unit 142 comprises an image data input unit 150, an ink volume conversion unit 152, a CMYK ink volume correction unit 154, a CMYK dot data generation unit 156, and an actuator drive waveform generation unit 158.

The UV irradiation intensity data storage unit 144 stores relationships between UV irradiation intensities and durations required for UV curing, as identified previously by experimentation, or the like.

The print mode control unit 146 sets the recording medium conveyance speed in accordance with each of the print modes, such as low-speed print mode, high-speed print mode, or the like, and calculates the UV irradiation duration from the UV irradiation length (namely, the conveyance length through the region where ultraviolet light is irradiated on the conveyance path of the recording medium), and sets a UV irradiation intensity derived from the UV irradiation intensity data storage unit 144 in accordance with the recording medium conveyance speed.

The coloring material optical density change data storage unit 148 stores optical density change values of coloring materials previously measured by experimentation, or the like, in various irradiation conditions, namely, combinations of the UV irradiation intensities and durations stored in the UV irradiation intensity data storage unit 144.

The image data input unit 150 reads in image data from the image buffer memory 122. The ink volume conversion unit 152 converts the ink volume when converting the RGB data into CMYK data, and in this process, the CMYK ink volume correction unit 154 corrects the CMYK ink ejection volumes.

The CMYK ink volume correction unit 154 reads out the optical density values after the change in the optical density of the coloring material due to UV irradiation, from the coloring material optical density change data storage unit 148, and corrects the CMYK ink ejection volumes in such a manner that the optical density values approach prescribed image densities. For example, in the case of the high-speed print mode, if the optical density of the coloring material is to be reduced in comparison with the low-speed print mode due to UV irradiation, then correction is carried out in order to increase the ink volume.

The CMYK dot data generation unit 156 generates CMYK dot data by performing a so-called digital halftoning process.

The actuator drive waveform generation unit 158 generates waveforms actually driving the actuators, from the dot data generated by the CMYK dot data generation unit 156, and supplies the drive waveforms to the head driver 124, thereby driving the head 12 to eject the ink.

Next, the treatment liquid and the ink used in the image forming apparatus 10 of the present embodiment are described.

In the inkjet recording apparatus 10 shown in the present embodiment, there is used an ink set constituted from various colored inks each containing a polymerizable compound, and a coloring material, and a treatment liquid containing a polymerization initiator, a diffusion preventing agent, and a high-boiling solvent.

"Polymerizable compound" refers to a compound that has a capability of undergoing polymerization and hence curing through the action of initiating species such as radicals generated from a polymerization initiator, described below.

Each polymerizable compound is preferably an addition polymerization-undergoing compound having at least one ethylenic unsaturated double bond therein, and is preferably selected from polyfunctional compounds having at least one terminal ethylenic unsaturated bond, more preferably at least two terminal ethylenic unsaturated bonds, therein. The group of such compounds is widely known in the industrial field in question, and these compounds can be used with no particular limitations thereon. These compounds include, for example, ones having chemical forms such as monomers, and prepolymers, i.e. dimers, trimers and other oligomers, and mixtures or copolymers thereof.

The polymerizable compound preferably has a polymerizable group such as an acryloyl group, a methacryloyl group, an allyl group, a vinyl group, or an internal double bond group (maleic acid etc.) in the molecule thereof. Of these, a compound having an acryloyl group or a methacryloyl group is preferable since the curing reaction can be brought about with little energy. In each liquid, one polymerizable compound only may be used, or a plurality of polymerizable compounds may be used in combination. The polymerizable compound content in the second liquid containing colorant is preferably in a range of 50 to 99% by mass, more preferably 70 to 99% by mass, yet more preferably 80 to 99% by mass, of the second liquid.

"Polymerization initiator" refers to a compound that generates initiating species such as radicals through light, or heat, or both of these types of energy, thus initiating and promoting the polymerization of the polymerizable compound(s). A publicly known thermal polymerization initiator, a compound having therein a bond with a low bond dissociation energy, a photopolymerization initiator, or the like can be selected and used.

Examples of such radical generating agents include halogenated organic compounds, carbonyl compounds, organic peroxide compounds, azo type polymerization initiators, azide compounds, metallocene compounds, hexaarylbiimidazole compounds, organic borate compounds, disulfonic acid compounds, and onium salt compounds.

In the ink set used in the present embodiment, a polymerization initiator that cures the polymerizable compound(s) is contained in at least one of the plurality of liquids used.

From the viewpoint of stability over time, curability and curing rate, the polymerization initiator content is preferably 0.5 to 20% by mass, more preferably 1 to 15% by mass, yet more preferably 3 to 10% by mass, relative to all of the polymerizable compounds used in the ink set. One polymerization initiator may be used, or a plurality of polymerization initiators may be used in combination. Moreover, so long as there is no impairment of the effects of the present embodiment, the polymerization initiator(s) may be used together with a publicly known sensitizer with an object of improving the sensitivity.

There are no particular limitations on the colorants used in the present embodiment. So long as these colorants are such that a hue and color density suitable for the ink usage can be attained, ones selected as appropriate from publicly known water-soluble dyes, oil-soluble dyes and pigments can be used. Of these, from the viewpoint of ink droplet ejection stability and quick drying ability, the liquids constituting the inkjet recording inks in the present embodiment are preferably water-insoluble liquids not containing an aqueous solvent. From this viewpoint, it is preferable to use an oil-soluble dye or pigment that readily disperses or dissolves uniformly in the water-insoluble liquid.

There are no particular limitations on oil-soluble dyes that can be used in the present embodiment, with it being possible to use one chosen as desired. The dye content in the case of using an oil-soluble dye as a colorant is preferably in a range of 0.05 to 20% by mass, more preferably 0.1 to 15% by mass, particularly preferably 0.2 to 6% by mass, in terms of solid content. A mode in which a pigment is used as a colorant is preferable from the viewpoint of aggregation readily occurring when the plurality of liquids are mixed together.

As pigments that can be used in the present embodiment, either organic pigments or inorganic pigments can be used. A carbon black pigment is preferable as a black pigment. In general, a black pigment, and pigments of the three primary colors, cyan, magenta and yellow, are used; however, pigments having other hues, for example red, green, blue, brown or white pigments, pigments having a metallic luster such as gold or silver pigments, uncolored or light body pigments, and so on may also be used in accordance with the object.

Moreover, particles obtained by fixing a dye or a pigment to the surface of a core material made of silica, alumina, a resin or the like, an insoluble lake pigment obtained from a dye, a colored emulsion, a colored latex, or the like may also be used as a pigment.

Furthermore, a resin-coated pigment may also be used. Such a resin-coated pigment is known as a "microcapsule pigment", and is commercially available from manufacturers such as Dainippon Ink and Chemicals Inc. and Toyo Ink Manufacturing Co., Ltd.

From the viewpoint of the balance between the optical density and the storage stability, the volume average particle diameter of the pigment particles contained in a liquid in the present embodiment is preferably in a range of 30 to 250 nm, more preferably 50 to 200 nm. Here, the volume average particle diameter of the pigment particles can be measured, for example, using a measuring apparatus such as an LB-500 (made by HORIBA Ltd.).

From the viewpoint of the optical density and the ejection stability, the pigment content in the case of using a pigment as a colorant is preferably in a range of 0.1 to 20% by mass, more preferably 1 to 10% by mass, in terms of solid content in each first liquid. One colorant only may be used, or a plurality of colorants may be used mixed together. Moreover, different colorants, or the same colorants, may be used in each of the liquids.

In the present embodiment, "diffusion preventing agent" refers to a substance contained in the second liquid with an object of preventing diffusion and smearing of the colorant-containing first liquids of which droplets are deposited onto the second liquid that has been put onto the recording medium.

As such a diffusion preventing agent, there is contained at least one selected from the group of polymers having an amino group, polymers having an onium group, polymers having a nitrogen-containing hetero ring, and metal compounds.

One of the above polymers or the like may be used, or a plurality may be used in combination. "Plurality" includes both, for example, the case of polymers that are polymers having an amino group but have different structures to one another, and the case of different types such as a polymer having an amino group and a polymer having an onium group. Moreover, a combination selected from amino groups, onium groups, nitrogen-containing hetero rings, and metal compounds may be present together in one molecule.

In the present embodiment, "high-boiling organic solvent" refers to an organic solvent that has a viscosity at 25° C. of not more than 100 mPa·s or a viscosity at 60° C. of not more than 30 mPa·s, and has a boiling point higher than 100° C.

Here, "viscosity" in the present embodiment refers to the viscosity obtained using a RE80 viscometer made by Toki Sangyo Co., Ltd. The RE80 viscometer is a conical rotor/flat plate type viscometer corresponding to the E type, and measurement is carried out using a rotor code No. 1 rotor at a rotational speed of 10 rpm. Note, however, that in the case of a viscosity higher than 60 mPa·s, measurement is carried out with the rotational speed changed to 5 rpm, 2.5 rpm, 1 rpm, 0.5 rpm, or the like as required.

Moreover, "solubility of water" in the present embodiment means the saturated concentration of water in the high-boiling organic solvent at 25° C., this being the mass (g) of water that can be dissolved in 100 g of the high-boiling organic solvent at 25° C.

The amount used of the high-boiling organic solvent is preferably 5 to 2000% by mass, more preferably 10 to 1000% by mass, in terms of the consumed amount relative to the colorant used.

In the present embodiment, a storage stabilizer may be added to each of the plurality of liquids with an object of suppressing undesirable polymerization during storage of the liquid. The storage stabilizer is preferably used in each of the liquids having the polymerizable compound(s) therein. Moreover, it is preferable to use a storage stabilizer that is soluble in the liquid or other coexisting components.

Examples of the storage stabilizer include quaternary ammonium salts, hydroxyamines, cyclic amides, nitrile compounds, substituted ureas, heterocyclic compounds, organic acids, hydroquinones, hydroquinone monoethers, organic phosphines, and copper compounds.

The amount added of the storage stabilizer is preferably adjusted as appropriate on the basis of the activity of the polymerization initiator used, the polymerizability of the polymerizable compound(s), and the type of the storage stabilizer. From the viewpoint of balance between the storage stability and the curability of the ink upon mixing the liquids, the amount added of the storage stabilizer is preferably 0.005 to 1% by mass, more preferably 0.01 to 0.5% by mass, yet more preferably 0.01 to 0.2% by mass, in terms of solid content in the liquid.

In the image forming apparatus 10 according to the present embodiment, besides using a spraying device based on inkjet nozzles as the device for depositing the first liquid onto the recording medium, it is also possible to use an application device, or other type of device.

There are no particular restrictions on the apparatus used for this application step, and it is possible to select a commonly known application apparatus, according to the required objective. Possible examples of such a device include: an air doctor coater, a blade coater, a rod coater, a knife coater, a squeeze coater, an immersion coater, a reverse roll coater, a transfer roll coater, a gravure coater, a kiss roll coater, a cast coater, a spray coater, a curtain coater, an extrusion coater, or the like.

For the exposure light source used in the present embodiment to promote the polymerization of the polymerizable compound, it is possible to use ultraviolet, visible light, or the like. Moreover, it is also possible to apply energy by means of radiation other than light, such as $\alpha$ rays, $\gamma$ rays, X rays, an electron beam, or the like, but of the various options, the use of ultraviolet light or visible light is most desirable from the viewpoints of cost and safety, and use of ultraviolet light is especially desirable. The amount of energy required for the curing reaction varies depending on the type and amount of the polymerization initiator, but in general, it is about 1 to 500 $mJ/cm^2$.

Below, the action of the present embodiment is described.

In the present embodiment, an ultraviolet-curable ink is used and the ultraviolet-curable ink is cured by irradiating ultraviolet light (UV). The UV irradiation energy Q required to cure the ultraviolet-curable ink is determined by the product of the UV irradiation intensity E and the UV irradiation duration t. In other words, it is represented by $Q=E\times t$.

In this case, even if the UV irradiation energy Q as represented by the product of the UV irradiation intensity E and the UV irradiation duration t, that is $E\times t$, is the same, a phenomenon occurs where the curing reaction of the ultraviolet-curable ink and/or the fading reaction of the coloring material in the UV ink varies with change in the UV irradiation intensity E and the UV irradiation duration t (namely, with change in the UV irradiation conditions). Then, a description of this phenomenon is given.

Between the low-speed print mode aimed at achieving high-quality image recording by conveying the recording paper at low speed, and a high-speed print mode aimed at speeding up image recording by conveying the recording paper at higher speed, there is a difference in the UV exposure and irradiation conditions (UV irradiation conditions) required to cure the ink dots formed by droplets deposited on the recording medium.

If the UV irradiation energy, the UV irradiation intensity and the UV irradiation duration in the low-speed print mode are taken respectively as Qa, Ea and ta, then the UV irradiation energy is expressed by $Qa=Ea\times ta$. If the UV irradiation energy, the UV irradiation intensity and the UV irradiation duration in the high-speed print mode are taken respectively as Qb, Eb and tb, then the UV irradiation energy is expressed by $Qb=Eb\times tb$.

The UV irradiation energy required in order to cure the ultraviolet-curable ink is set to an equal level for both low-speed print mode and high-speed print mode. In other words, using the symbols described above, Qa=Qb. In this case, since, in a normal apparatus, the length of the UV irradiation region in the direction of conveyance is an intrinsic value and the conveyance speed of the recording paper is faster in the case of the high-speed print mode, compared to the low-speed print mode, then the UV irradiation duration is shorter in the high-speed print mode compared to the low-speed print mode, and then ta>tb. Consequently, in order to make the UV irradiation energies equal, namely, to achieve Qa=Qb, it is necessary to make the UV irradiation intensity stronger in the high-speed mode, which has a shorter irradiation duration, and then Ea<Eb.

However, in the case of the high-speed print mode, even if the UV irradiation energy is equal to that during the low-speed print mode, namely, Qa=Qb, since ultraviolet light of high intensity is irradiated for a short duration, a phenomenon occurs in which the curing reaction of the ultraviolet-curable ink is incomplete.

Therefore, in the case of the high-speed print mode, it is possible reliably to achieve a curing reaction of the ultraviolet-curable ink by setting either the UV irradiation intensity Eb or the UV irradiation duration tb to a greater value.

Here, if the conveyance speed of the recording paper is fixed and the UV irradiation duration tb is hence uniform, then the UV irradiation intensity Eb is changed to a larger value Eb', and a curing reaction of the ultraviolet-curable ink is carried out reliably at a UV irradiation energy Qb'=Eb'×tb, which is greater than Qb.

Consequently, in this case, ultimately, ultraviolet light is irradiated under the following conditions:

in the low-speed print mode: Qa=Ea×ta; and in the high-speed print mode: Qb'=Eb'×tb.

FIG. 14A is a table of the foregoing information. As shown in FIG. 14A, in the case of the low-speed print mode, the UV irradiation intensity Ea is not set to a very strong level, and hence the incomplete curing reaction phenomenon does not occur, and the UV irradiation energy is set to Qa=Ea×ta.

On the other hand, in the case of the high-speed print mode, the UV irradiation intensity Eb is set to a correspondingly higher irradiation intensity (Eb=Ea×ta/tb), but since the irradiation duration is very short, then the curing reaction may not proceed quickly enough, and an incomplete curing reaction may arise. If the incomplete curing reaction phenomenon does not occur, then the UV irradiation energy may be set to Qb=Eb×tb (in this case, Qb=Qa). If, however, the incomplete curing reaction phenomenon does occur, then the UV irradiation intensity Eb is raised to Eb', and hence the UV irradiation energy is set to a higher level of Qb'=Eb'×tb (Qb'>Qb=Qa), in such a manner that a reliable UV curing reaction is achieved.

Furthermore, on the other hand, the optical density of the coloring material included in the ultraviolet-curable ink changes when the coloring material receives irradiation of ultraviolet light. The amount of the optical density change is uniform in both low-speed print mode and a medium-speed print mode which lies between low-speed print mode and high-speed print mode, provided that the UV irradiation energy amount is the same. However, in the high-speed print mode, the UV irradiation intensity Eb is set to a correspondingly higher irradiation intensity (Eb=Ea×ta/tb), but since the irradiation duration is very short, the fading reaction of the ink may not proceed quickly enough, and a phenomenon of an incomplete fading reaction similar to the incomplete ultraviolet curing reaction phenomenon may occur. In the high-speed print mode, if the incomplete fading reaction phenomenon occurs, then there is a greater probability of variation in the optical density change of the coloring material after UV irradiation, due to difference in the UV irradiation conditions, compared to the low-speed print mode.

This is shown in FIG. 14B. Here, it is presumed that the incomplete curing reaction phenomenon due to high-intensity UV irradiation does not occur (namely, Qa=Qb). In the high-speed print mode, the UV irradiation intensity is set to a correspondingly stronger value, but since the irradiation duration is very short, then the fading reaction of the ink caused by the irradiation of ultraviolet light does not proceed quickly enough, and consequently, the amount of the fading change in the high-speed print mode is relatively small compared to the amount of the fading change in the low-speed print mode, and hence the optical density of the coloring material remains relatively high.

If the UV irradiation conditions affect the curing reaction of the ultraviolet-curable ink and the optical density change (fading) of the coloring materials, then there are variations in the final optical densities after the optical density change of the coloring materials. The variations are shown in FIG. 15.

As shown in FIG. 15, in the high-speed print mode, firstly, if incomplete curing occurs due to high-intensity UV irradiation, as in case 1, then it is necessary to increase the intensity E in order to cure the ink. In this case, with respect to the optical density change of the coloring material, since the UV irradiation intensity is raised, then the deterioration of the coloring material increases, and the final optical density of the coloring material is reduced relatively in comparison with case 2, which is described below.

In case 2 relating to the high-speed print mode, there is no occurrence of incomplete curing due to high-intensity UV irradiation, and hence no increase in the UV irradiation intensity is necessary. In this case, with respect to the optical density change of the coloring material, since the UV irradiation intensity is not raised, then there is little deterioration of the coloring material, and the final optical density of the coloring material is maintained relatively high in comparison with case 1.

Since the UV irradiation conditions vary in this way with change in the characteristics of the curing reaction of the coloring materials of the respective colors, then the final optical densities of the coloring materials vary.

In the present embodiment, desirably, the coloring material is designed with a preference for the low-speed print mode, which aims to achieve high-quality image recording.

In other words, the ingredients of the coloring material are designed and manufactured by envisaging the optical density change occurring in the coloring material due to UV irradiation in the low-speed print mode. In this case, in the low-speed print mode, there is no occurrence of the incomplete curing reaction phenomenon due to high-intensity UV irradiation, and hence ultraviolet light is irradiated under low-intensity irradiation conditions and the prescribed color density is obtained in the coloring material after irradiation of the ultraviolet light. Therefore, it is possible to obtain an image of high quality without correction processing.

On the other hand, in the high-speed print mode, since the UV irradiation intensity is increased and the irradiation duration is shortened, the fading reaction does not proceed quickly enough and the optical density of the coloring material is relatively high compared to the low-speed print mode. Therefore, in the present embodiment, the optical density change of the coloring material in the high-speed print mode (the variation in the optical density change with respect to the low-speed print mode) is considered in advance, and the CMYK ink volume data is corrected accordingly, in such a manner that an image having the prescribed graduated tonal densities is obtained.

In the case of the optical density of the coloring material becoming lower than a prescribed value due to UV irradiation in the high-speed print mode, although cases may occur where the maximum optical density cannot be achieved even if the ejected ink volume is corrected, it is possible to improve the optical density to a certain extent by correcting the ejected ink volume. In particular, in the high-speed print mode which prioritizes high productivity, it is particularly effective if the image density lies within a tolerable range, even if it does not coincide strictly with a prescribed value. On the other hand, in the low-speed print mode which emphasizes high image quality, priority is given to making the optical density of the coloring material coincide with the prescribed value.

Furthermore, depending on the type of recording medium used, there may also be cases where the ultraviolet-curable ink permeates into the recording medium before the ink becomes cured, thereby causing bleeding. In this case, independently of the print mode (high-speed print mode or low-speed print mode), it is necessary to reduce the amount of deposited ink that permeates into the recording medium, by UV curing of the ink at an early stage after the UV ink lands on the medium.

On the other hand, when ultraviolet light is irradiated over the required UV irradiation intensity, there is a problem in that the ultraviolet-curable ink inside nozzles may be cured by the diffraction of ultraviolet light, thus leading to blockages. Consequently, the minimum required UV irradiation intensity is set in accordance with the recording medium used. In this case, since ultraviolet light is irradiated onto various types of recording media under differing UV irradiation intensity conditions, then the ejected ink volume is corrected in accordance with the variation in the optical density change of the coloring material, in response to the occurrence of incomplete curing due to high-intensity UV irradiation.

Furthermore, in the case of an image forming apparatus having two-stage curing devices, namely, the semi-curing device for preventing landing interference and the main curing device for performing final fixing, as in the present embodiment, the present invention can be applied to the final optical density change of the coloring material produced by these two stages of curing.

Below, the control procedure implemented in the image forming method of the present embodiment in order to correct the variation in the optical density change of the coloring material produced by difference in the UV irradiation conditions, in particular, is described with reference to the flowchart in FIG. 16.

Figure 16:
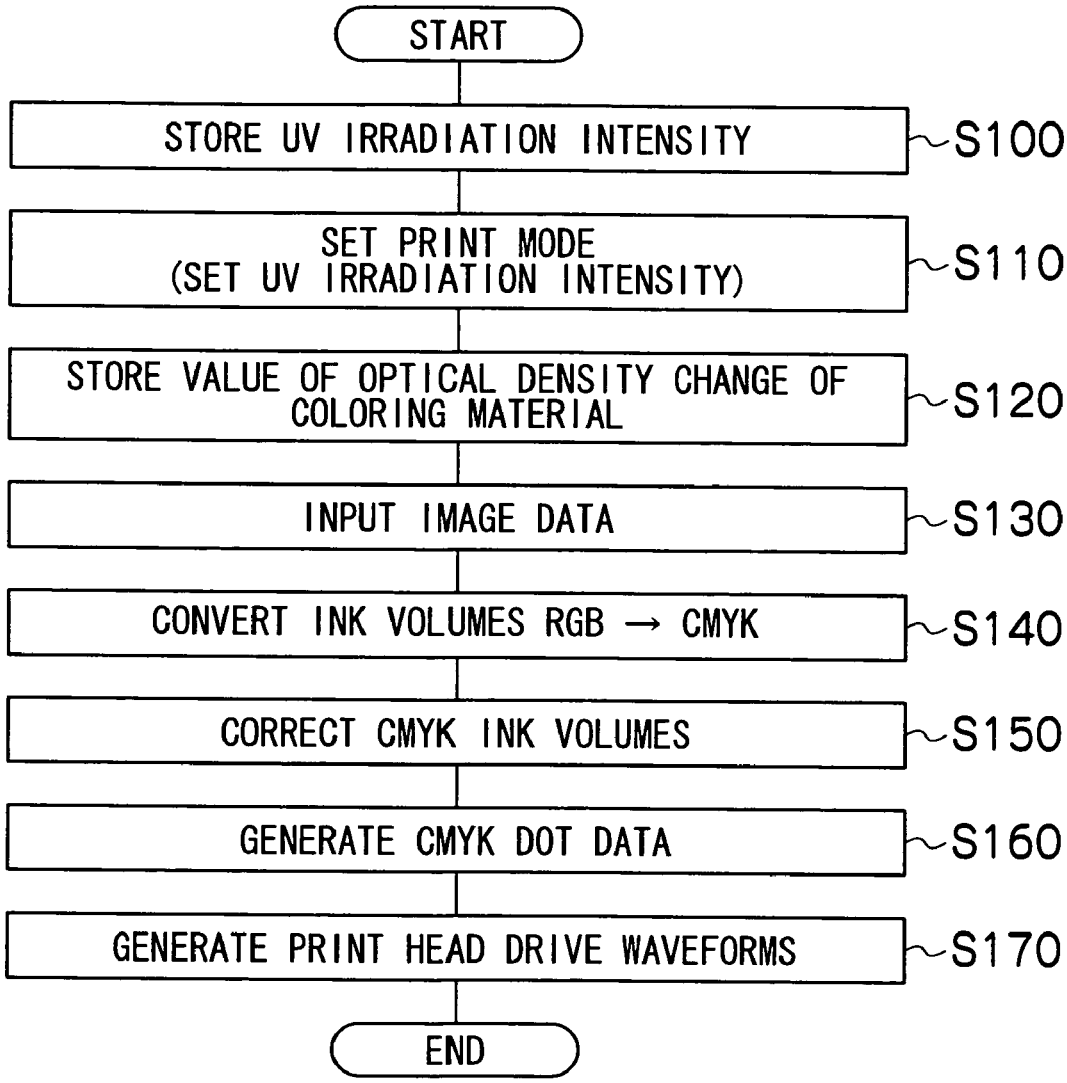
FIG. 16 is a flowchart showing an image recording method according to the present embodiment.

Firstly, in step S100 in FIG. 16, the relationship between the UV irradiation intensity (E1, E2, . . . ) and duration (t1, t2, . . . ) required for UV curing is obtained in advance by experimentation, or the like, and is stored in the UV irradiation intensity data storage unit 144. Here, in many cases, the product of the UV irradiation intensity Ei and the UV irradiation duration ti has various different values.

Next, the print mode is set in step S110. In other words, in the print mode control unit 146, the recording medium conveyance speed and the UV irradiation duration corresponding to the respective print mode are calculated and set. For example, in the case of the low-speed print mode aimed at high image quality, the recording medium conveyance speed is set to V1, and in the case of the high-speed print mode, it is set to a faster conveyance speed V2 (V1<V2).

The UV irradiation duration is calculated and set on the basis of the UV irradiation length L (the length of the UV irradiation area in the conveyance direction). In the case of the low-speed print mode, for example, the UV irradiation duration t1 is found by dividing the UV irradiation length L by the recording medium conveyance speed V1, namely, t1=L/V1. Similarly in the case of the high-speed print mode, the UV irradiation duration t2 is found by dividing the UV irradiation length L by the recording medium conveyance speed V2, namely, t2=L/V2.

Moreover, the UV irradiation intensity is set from the UV irradiation intensity data storage unit 144, in accordance with the recording medium conveyance speed of each print mode.

Next, at step S120, the values of the optical density change of the coloring material are measured in advance by experimentation, or the like, under the irradiation conditions based on the UV irradiation intensities and durations stored in the UV irradiation intensity data storage unit 144, and as shown in FIG. 17A, the optical density values after the optical density change of the coloring material are stored in the coloring material optical density change data storage unit 148, for each color of ink and in respect of each print mode.

Thereupon, at step S130, the image data is inputted from the image data input unit 150. This is done, for example, by extracting the image data stored in the image buffer memory 122.

Next, at step S140, the ink volume conversion unit 152 converts the input RGB image data into CMYK data.

On the other hand, at step S150, the CMYK ink volume correction unit 154 reads out the optical density values after the change in the optical densities of the coloring materials due to UV irradiation, from the coloring material optical density change data storage unit 148, and the CMYK ink volume correction unit 154 corrects the CMYK ink ejection volumes accordingly, in such a manner that the optical density values after the change approach prescribed image densities. For example, in the case of the high-speed print mode, if the optical density of one of the coloring materials is reduced in comparison with the low-speed print mode, due to UV irradiation, then correction is carried out in order to increase the ejection volume of the corresponding ink.

The correction processing of the ink ejection volume can be performed in respect of both the high-speed print mode in which image recording is performed at high speed and the low-speed print mode aimed at achieving high-quality images, or alternatively, the correction processing may be omitted in the low-speed print mode, and the correction processing is carried out only in the high-speed print mode in which variation in the optical density change of the coloring material occurs under high-intensity UV irradiation.

Furthermore, it is also possible to carry out correction processing in response to the UV irradiation conditions corresponding to types of recording paper 20 determined by the media determination unit 126. In this case, it is also possible to determine the UV irradiation condition by combining the type of the recording paper (recording medium) 20 and the print mode, and to carry out correction processing in accordance with this. By this means, it is possible to set conditions and carry out correction processing in a highly precise fashion.

Thereupon, at step S160, the CMYK dot data generation unit 156 performs digital halftoning, thereby generating dot data.

Finally, at step S170, the actuator drive waveform generation unit 158 generates drive waveforms in order to drive the actuators 58 of the print head 50. The generated drive waveforms are supplied to the head driver 124, and the actuators 58 of the print heads 50 (12Y, 12C, 12M and 12K) are driven, thereby ejecting inks of respective colors and forming an image.

In this way, according to the present embodiment, even if there is a variation in the optical density change of the coloring material due to variation in the UV irradiation conditions, by considering the optical density change in advance and correcting the CMYK ink volume data accordingly, it is possible to obtain an image having a prescribed tonal graduation.

In order to simplify the descriptions with reference to FIG. 17A, only one UV light source is taken into consideration. Another case is described here in which there is a plurality of UV light sources, as shown in FIG. 1, such as the preliminary curing light source on the downstream side of each ink color head, and the main curing light source on the furthest downstream side.

If there are the plurality of UV irradiation light sources as shown in FIG. 1, then the K dots receive UV irradiation four times, the M dots, three times, the C dots, two times, and the Y dots, once. FIG. 17B shows an example of a table which stores UV irradiation conditions and final optical densities of coloring materials, for high-speed print mode and low-speed print mode. Here, FIG. 17B shows the UV irradiation conditions relating to all of the UV light sources, but the number of times that ultraviolet light is received (namely, the irradiation conditions), differ between the dots of the respective colors. FIG. 17B shows an example where there is a total of two print modes, namely, one type of high-speed print mode and one type of low-speed print mode, but it is also possible, for example, to set a plurality of UV irradiation conditions in accordance with various types of recording media, and the like, within the high-speed mode, and to store final coloring material optical densities corresponding to these UV irradiation conditions.

In the embodiment described above, ultraviolet-curable ink is used as an example, but the present invention is not limited to ultraviolet-curable ink, and it may also be applied to a generic radiation-curable ink.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an ink ejection head which deposits radiation-curable ink containing a coloring material onto a recording medium;

a radiation curing device which irradiates the deposited radiation-curable ink on the recording medium with radiation to cure the deposited radiation-curable ink;

an optical density change calculation device which stores optical density change values of the coloring material with respect to different irradiation conditions of the radiation, and calculates a variation in optical density change of the coloring material produced by difference in the irradiation conditions of the radiation; and a correction device which performs correction processing of a volume of the radiation-curable ink to be deposited on the recording medium according to the variation in the optical density change of the coloring material in the radiation-curable ink calculated by the optical density change calculation device.

2. The image forming apparatus as defined in claim 1, wherein the correction device performs the correction processing with respect to both a high-speed print mode for recording images at high speed, and a low-speed print mode for achieving high-quality images.

3. The image forming apparatus as defined in claim 1, wherein the correction device corrects the volume of the radiation-curable ink to be deposited on the recording medium according to fading change of the coloring material in the radiation-curable ink produced when an irradiation energy amount that is applied by the radiation curing device to the radiation-curable ink deposited on the recording medium in a high-speed print mode and an irradiation energy amount that is applied by the radiation curing device to the radiation-curable ink deposited on the recording medium in a low-speed print mode are set equal to each other.

4. The image forming apparatus as defined in claim 1, wherein the correction device corrects the volume of the radiation-curable ink to be deposited on the recording medium according to fading change of the coloring material in the radiation-curable ink produced when a curing state of the radiation-curable ink deposited on the recording medium in a high-speed print mode and a curing state of the radiation-curable ink deposited on the recording medium in a low-speed print mode are set equal to each other.

5. The image forming apparatus as defined in claim 2, wherein the correction device performs the correction processing in accordance with the irradiation conditions of the radiation corresponding to a combination of a type of the recording medium and each of the high-speed print mode and the low-speed print modes.

6. The image forming apparatus as defined in claim 1, wherein the correction device performs the correction processing with respect to a high-speed print mode for recording images at high speed, and performs no correction processing with respect to a low-speed print mode for achieving high-quality images.

7. The image forming apparatus as defined in claim 1, wherein the correction device performs the correction processing in accordance with the irradiation conditions of the radiation corresponding to a type of the recording medium.

* * * * *